US005561098A

United States Patent [19]

Ikemoto

[11] Patent Number: 5,561,098

[45] Date of Patent: Oct. 1, 1996

[54] TRANSFER PRINTING METHOD AND HEAT-MELT TRANSFER MEDIUM USABLE IN THE METHOD

[75] Inventor: Manabu Ikemoto, Osaka, Japan

[73] Assignee: Fujicopian Co., Ltd., Osaka, Japan

[21] Appl. No.: 331,287

[22] Filed: Oct. 28, 1994

[30] Foreign Application Priority Data

Oct. 29, 1993 [JP] Japan ..... 5-272772

[51] Int. Cl.[6] ..... B41M 5/035; B41M 5/38

[52] U.S. Cl. ..... 503/227; 156/235; 156/240; 428/195; 428/204; 428/480; 428/484; 428/488.1; 428/488.4; 428/913; 428/914

[58] Field of Search ..... 8/471; 156/235, 156/240; 428/195, 204, 913, 914, 480, 484, 488.1, 488.4; 503/227

[56] References Cited

U.S. PATENT DOCUMENTS 4,021,591 5/1977 Devries et al. ..... 428/200
4,058,644 11/1977 Devries et al. ..... 428/200
4,576,610 3/1986 Donenfeld ..... 8/471
5,006,502 4/1991 Fujimura et al. ..... 503/227
5,296,444 3/1994 Saiki et al. ..... 503/227

FOREIGN PATENT DOCUMENTS 57-102390 6/1982 Japan ..... 503/227

*Primary Examiner*—Bruce H. Hess
*Attorney, Agent, or Firm*—Fish & Neave

[57] ABSTRACT

A transfer printing method is provided which comprises the steps of: selectively melt-transferring at least one of heat-meltable ink layers Y, M and C containing heat-migrating dyes for respective colors onto a foundation to form an ink image on the foundation, selectively melt-transferring a heat-meltable layer T containing a readily dyeable heat-meltable resin onto the ink image, giving a master sheet, and placing the master sheet on an image receptor and heating the resulting assembly under pressure to form a dyed image on the image receptor. The transfer printing method gives a clear dyed image, especially a clear full-color dyed image, on any image receptor regardless of the kind thereof.

3 Claims, 1 Drawing Sheet

TRANSFER PRINTING METHOD AND HEAT-MELT TRANSFER MEDIUM USABLE IN THE METHOD

BACKGROUND OF THE INVENTION

The present invention relates to a transfer printing method wherein with utilization of a thermal transfer technique there is fabricated a master sheet having thereon a master image containing heat-migrating dyes for yellow, magenta and cyan, and then the heat-migrating dyes in the master image are transferred onto an image receptor to form a dyed image thereon, and a heat-melt transfer medium usable in the transfer printing method.

Heretofore, there was proposed a transfer printing method wherein with use of a color thermal transfer printer, a heat-meltable ink layer containing a disperse dye for yellow, a heat-meltable ink layer containing a disperse dye for magenta and a heat-meltable ink layer containing a disperse dye for cyan are selectively melt-tranferred onto a foundation for master sheet in a predetermined order according to image signals to form a master image on the foundation, and the thus obtained master sheet carrying the master image is placed on an image receptor and the resulting assembly is heated under pressure to form a full-color dyed image on the image receptor (refer to Japanese Unexamined Patent Publication No. 327988/1992).

However, this method has a drawback that a clear full-color image can not be obtained unless the image receptor is one which is readily dyed with the disperse dye, for example, a polyester fabric.

In view of the above, it is an object of the present invention is to provide a transfer printing method capable of forming a dyed image, especially a full-color dyed image, on any image receptor regardless of the kind thereof.

Another object of the present invention is to provide a heat-melt transfer medium useful in the above-mentioned transfer printing method.

These and other objects of the present invention will become apparent from the description hereinafter.

SUMMARY OF THE INVENTION

The present invention provides a transfer printing method comprising the steps of:

selectively melt-transferring at least one of a heat-meltable ink layer Y containing a heat-migrating dye for yellow, a heat-meltable ink layer M containing a heat-migrating dye for magenta and a heat-meltable ink layer C containing a heat-migrating dye for cyan onto a foundation for master sheet in a predetermined order according to image signals to form a primary ink image, a secondary ink image or a tertiary ink image on the foundation, selectively melt-transferring a heat-meltable layer T containing as a major component a heat-meltable resin which is readily dyeable with each of the heat-migrating dyes, onto the ink image, giving a master sheet, and placing the master sheet on an image receptor so that the ink image faces the image receptor, and heating the resulting assembly under pressure to form a dyed image on the image receptor.

The present invention further provides a heat-melt transfer medium useful for producing a master sheet for use in a transfer printing method, comprising a single support having thereon a heat-meltable ink layer Y containing a heat-migrating dye for yellow, a heat-meltable ink layer M containing a heat-migrating dye for magenta, a heat-meltable ink layer C containing a heat-migrating dye for cyan, and a heat-meltable layer T containing as a major component a heat-meltable resin which is readily dyeable with each of the heat-migrating dyes, the ink layers Y, M, C and the dyeable layer T being repeatedly disposed in a side-by-side relationship on the support in a recurring unit comprising the ink layers Y, M and C, and the dyeable layer T arranged in a predetermined order.

The present invention further provides an assembly of plural heat-melt transfer media useful for producing a master sheet for use in a transfer printing method, comprising a first heat-melt transfer medium comprising a support having thereon a heat-meltable ink layer Y containing a heat-migrating dye for yellow, a second heat-melt transfer medium comprising a support having thereon a heat-meltable ink layer M containing a heat-migrating dye for magenta, a third heat-melt transfer medium comprising a support having thereon a heat-meltable ink layer C containing a heat-migrating dye for cyan, and a fourth heat-melt transfer medium comprising a support having thereon a heat-meltable layer T containing as a major component a heat-meltable resin which is readily dyeable with each of the heat-migrating dyes.

Herein the above-mentioned primary ink image, secondary ink image and tertiary ink image mean the following:

(1) Primary ink image

The primary ink image is defined as an ink image wherein ink dots of at least one of yellow ink, magenta ink and cyan ink are present on the master sheet so that they are not superimposed one on another but are disposed in a side-by-side relationship.

Accordingly, an ink image wherein ink dots of only one of yellow ink, magenta ink and cyan ink are present on the master sheet is, of course, a primary ink image. Further, an ink image wherein ink dots of two or three of yellow ink, magenta ink and cyan ink are present on the master sheet is also a primary ink image, as far as these different color ink dots are not superimposed one on another but are disposed in a side-by-side relationship.

When a heat-meltable ink layer Bk containing a heat-migrating dye for black is used, the primary ink image may include ink dots of black ink which are not superimposed with other color ink dots.

(2) Secondary ink image

The secondary ink image is defined as an ink image including a region wherein ink dots of two of yellow ink, magenta ink and cyan ink are present on the master sheet so that they are superimposed one on another.

A dyed image obtained from the secondary ink image including that region develops a color (green, red, blue) on the basis of subtractive color mixture in a part corresponding to that region.

The secondary ink image may include a region of the primary ink image.

(3) Tertiary ink image

The tertiary ink image is defined as an ink image including a region wherein ink dots of all of yellow ink, magenta ink and cyan ink are present on the master sheet so that they are superimposed one on another.

A dyed image obtained from the tertiary ink image including that region develops a color (black) on the basis of subtractive color mixture in a part corresponding to that region.

The tertiary ink image may include a region of the primary ink image and/or a region of the secondary ink image.

DETAILED DESCRIPTION

Figure 1:
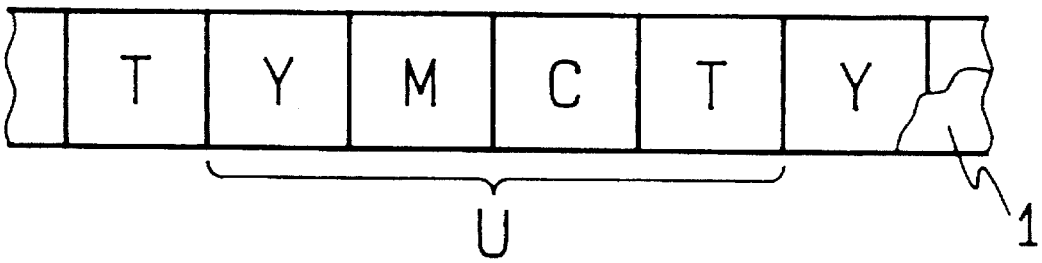
FIG. 1 is a plan view showing an arrangement of respective layers in a heat-melt transfer medium according to the present invention.

According to the transfer printing method of the present invention, first a master sheet carrying thereon a master image is fabricated by use of a color thermal transfer printer. In that case, after an ink image containing heat-migrating dyes is formed on a foundation for master sheet, a heat-meltable layer containing as a major component a heat-meltable resin which is readily dyeable with the heat-migrating dyes is selectively melt-transferred onto the foundation having the ink image thereon so as to cover at least the ink image.

In the transfer printing step, when the thus obtained master sheet is pressed against an image receptor and heated, the dyeable heat-meltable layer is transferred onto the image receptor and simultaneously a dyed image is formed in the dyeable heat-meltable layer.

In the present invention, the dyeable heat-meltable layer of the heat-melt transfer medium serves as a dye-receiving layer after being transferred to the image receptor. Accordingly, the present invention has an advantage that a clear dyed image can be formed on an image receptor even if the image receptor is not readily dyeable.

Further, in the step of fabricating a master sheet, the dyeable heat-meltable layer serving as a dye-receiving layer is melt-transferred onto an ink image on the master sheet from the heat-melt transfer medium when the ink image is formed on the master sheet by the thermal transfer, and the dyeable heat-meltable layer thus obtained on the master sheet is then transferred onto an image receptor in the transfer printing step. Accordingly, the present invention has another advantage that the method does not involve a complicated step of imparting easy dyeability to the image receptor separately from the step of fabricating the master sheet.

The present invention will be explained in detail.

In the transfer printing method of the present invention, first a master sheet is fabricated.

The master sheet is fabricated by selectively melt-transferring at least one of a heat-meltable ink layer Y containing a heat-migrating dye for yellow, a heat-meltable ink layer M containing a heat-migrating dye for magenta and a heat-meltable ink layer C containing a heat-migrating dye for cyan onto a foundation for master sheet in a predetermined order according to image signals to form a primary ink image, a secondary ink image or a tertiary ink image on the foundation, and then selectively melt-transferring a heat-meltable layer T containing as major component a heat-meltable resin which is readily dyeable with each of the heat-migrating dyes, onto the ink image.

In the present invention, usually, two or three of the ink layers Y, M and C are successively melt-transferred onto a foundation for master sheet to form a secondary ink image or a tertiary ink image, thereby forming the so-called full-color dyed image on the basis of subtractive color mixture. However, the method of the present invention can be utilized for forming a dyed image of at least one of yellow, magenta and cyan by forming on the master sheet a primary ink image involving no mutually superimposed different color ink dots.

The transfer order of the ink layers Y, M and C can be arbitrarily determined.

A dyed image in black can be obtained from an ink image (tertiary ink image) which is formed by mutually superimposing the ink layers Y, M and C. Alternatively, a dyed image in black can be obtained from an ink image (primary ink image) which is formed by using a heat-meltable ink layer Bk containing a heat-migrating dye for black.

The heat-melt transfer medium for use in fabricating a master sheet in accordance with the present invention includes one wherein the ink layer Y, the ink layer M and the ink layer C (and optionally the ink layer Bk), and the dyeable heat-meltable layer T are disposed in a side-by-side relationship on a single support.

FIG. 1 illustrates an example of an arrangement of the layers in the aforesaid heat-melt transfer medium. In FIG. 1, the ink layer Y, the ink layer M, the ink layer C and the dyeable layer T, each of which preferably has a given constant size, are repeatedly disposed in a side-by-side relationship on a single support 1 in a recurring unit U wherein the ink layers Y, M and C, and the dyeable layer T are arranged in a predetermined order.

The arranging order of the ink layers Y, M and C, and the dyeable layer T in the recurring unit U is arbitrary as far as they are arranged so that the dyeable layer T can be transferred lastly. An ink layer Bk may be included in the recurring unit U.

The ink layers Y, M and C (and optionally the ink layer Bk) and the dyeable layer T may be disposed in a side-by-side relationship on a single support in a stripe form along the longitudinal direction of the support.

Another example of the heat-melt transfer medium is one wherein the ink layers Y, M and C (and optionally the ink layer Bk) and the dyeable layer T are disposed on separate supports, respectively.

The ink layers Y, M, C and Bk are each composed of a heat-meltable ink containing a heat-migrating dye. Any conventional ink of this type is usable in the present invention.

The heat-migrating dye is herein defined as a dye which is transferable from the ink image to the dyeable layer by diffusion, sublimation (including volatilization) or a like phenomenon upon heating in the transfer printing step. Conventional disperse dyes and the like for use in the transfer printing method and a like method can be used without any particular limitation. Examples thereof are as follows:

Yellow heat-migrating dye

- C.I. Disperse Yellow 3 (azobenzene dye), 23 (disazo dye), 7, 60 (pyrazoloneazo dye), 13 (benzanthrone dye), 54 (quinophthalone dye), 61 (methine dye), 82 (coumarin dye), 1, 5, 42, 141, 201, E, E-GRL Magenta heat-migrating dye

- C.I. Disperse Red B, 1 (aminoazobenzene dye), 17, 4 (1-amino-4-hydroxyanthraquinone dye), 60, 135, 167, 210
- C.I. Disperse Violet 26
- C.I. Solvent Red 19, 155

Cyan heat-migrating dye

- C.I. Disperse Blue 14, 26 (4, 8-diaminoanthraquinone dye), 3, 24, 56, 20 (naphthoquinone dye), 106
- C.I. Solvent Blue 36, 63, 78, 105, 112
- C.I. Disperse Violet 28 (1,4-diaminoanthraquinone dye)

These heat-migrating dyes for each color may be used singly or in admixture. Suitable heat-migrating dyes are those having a heat-migrating temperature of 60° C. or above.

Examples of the heat-migrating dye for black are mixtures of the aforesaid heat-migrating dyes for yellow, magenta and cyan in an appropriate proportion.

The vehicle of the heat-meltable ink is composed of a wax or a mixture of a wax and a heat-meltable resin, and optionally an oily substance.

Examples of the wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax and Fischer-Tropsch wax; higher fatty acids such as lauric acid, myristic acid, palmitic acid, stearic acid and behenic acid; higher aliphatic alcohols such as stearyl alcohol and behenyl alcohol; esters such as higher fatty acid monoglycerides, sucrose fatty acid esters and sorbitan fatty acid esters; and amides such as oleic amide. These waxes may be used singly or in admixture.

Preferable as the heat-meltable resin are those compatible or miscible with the waxes. Examples of the heat-meltable resin include xylene resin, coumarone-indene resin, styrene resin, ethylene-vinyl acetate copolymer resin, ethylene-alkyl (meth)acrylate copolymer resin, ethylene-butadiene copolymer resin, (meth)acrylic acid ester resin, polyamide resin, polyester resin and polyurethane resin. These resins may be used singly or in admixture.

Examples of the oily substance are vegetable oils such as rapeseed oil and castor oil, mineral oils such as motor oil and spindle oil, and plasticizers such as dioctyl phthalate, dibutyl phthalate and tricresyl phosphate.

A surface active agent may be added to the heat-meltable ink to improve the dispersibility of the heat-migrating dye. Examples of the surface active agent are sorbitan fatty acid ester, polyoxyethylene alkylphenyl ether and phosphoric acid alkyl ester.

The content of the heat-migrating dye in the heat-meltable ink layer for each color is preferably from 5 to 70% (% by weight, hereinafter the same), especially from 20 to 45%.

The vehicle may be composed of the wax alone. However, from the viewpoint of improving the application property of the ink, etc., it is preferable to use a heat-meltable resin in combination. When the heat-meltable resin is used in combination, the amount of the heat-meltable resin is preferably from 20 to 100 parts (parts by weight, hereinafter the same), especially from 40 to 80 parts, relative to 100 parts of the wax. When the amount of the resin is less than the above range, the effect of improving the application property is not sufficiently exhibited, and in the case that the foundation for master sheet is porous, the heating time in the transfer printing step tends to become longer because the ink permeates into the foundation. When the amount of the resin is more than the above range, an unwanted transfer of the ink layer which means the phenomenon that the ink is peeled off in a larger area including not only the heated portion but also the circumference thereof, occurs and the reproducibility of ink dot becomes poor, which results in failure to obtain a desired gradation.

The heat-meltable ink layer preferably has a melting or softening point of about 50° to 90° C., preferably about 60° to 80° C. and a viscosity of about 300 to $5\times10^5$ cP at 90° C. (value measured with a rheometer made by Rheology Co., Ltd., hereinafter the same). When the melting or softening point of the ink layer is below the above range, the storage stability of the transfer medium is apt to be degraded. When the melting or softening point is higher than the above range, the transfer sensitivity is apt to be degraded. When the viscosity at 90° C. is smaller than the above range, the strength of the ink layer is decreased so that the ink image of the master sheet tends to be smeared. When viscosity is larger than the above range, the transfer sensitivity is apt to be degraded.

The coating amount (coating amount after being dried, hereinafter the same) of the heat-meltable ink layer for each color is preferably from 0.5 to 5 g/m$^2$. When the coating amount is smaller than the above range, the density of the obtained dyed image is too low. When the coating amount is larger than the above range, the transfer sensitivity is poor, the abrasion resistance of the ink image on the master sheet is poor or there occurs the phenomenon that the ink layer falls off in the form of powder or flakes.

The ink layer for each color can be formed by applying the aforesaid ink composition in the form of a solvent solution or a dispersion, or by hot-melt coating of the composition as it is. The formation of the ink layer is preferably conducted at a temperature lower than the migrating or transfer temperature of the heat-migrating dye.

The dyeable heat-meltable layer T contains as a main component a heat-meltable resin which is readily dyeable with the aforesaid heat-migrating dye. Preferably the dyeable heat-meltable layer is substantially transparent.

Examples of the heat-meltable resin which is readily dyeable with the aforesaid heat-migrating dyes include polyester resins, acrylic resins and polyamide resins. Polyester resins are preferably used.

The polyester resins are those obtained by polycondensation of an acid component and a diol component. Examples of the acid component include saturated dibasic acids such as phthalic acid, phthalic anhydride, sebasic acid and azelaic acid, unsaturated dibasic acids such as maleic anhydride and fumaric acid, and dimer acids. These acid components can be used singly or in admixture. Examples of the diol component include ethylene glycol, propylene glycol, decanediol, dodecanediol, hexadecanediol, and bisphenol compounds and addition products of the bisphenol compounds with ethylene oxide and/or propylene oxide. These diol compounds can be used singly or in admixture.

The readily dyeable heat-meltable resin preferably has a melting or softening point of about 80° to 160° C. and a viscosity of about 100 to 4,000 cP at 200° C. When the melting or softening point of the dyeable heat-meltable resin is lower than the above range, the storage stability of the transfer medium becomes poor. When the melting or softening point is higher than the above range, the transfer sensitivity of the dyeable heat-meltable layer is apt to be degraded. When the viscosity at 200° C. is smaller than the above range, the dyeable heat-meltable resin is apt to be excessively penetrated into an image receptor such as fabrics in the transfer printing step, resulting in unclear dyed images. When the viscosity at 200° C. is larger than the above range, the transfer sensitivity of the dyeable heat-meltable layer is apt to be degraded.

A body pigment may be incorporated into the dyeable heat-meltable layer T to improve the selective transferability of the dyeable layer in the heat-melt transfer step. The content of the body pigment in the dyeable heat-meltable layer is preferably not more than about 10%, more preferably from about 1 to 7%.

Examples of the body pigment include silica, alumina, titanium oxide, magnesium carbonate, calcium carbonate and barium sulfate. Transparent body pigments are preferably used.

The coating amount of the dyeable heat-meltable layer is preferably from 2 to 10 g/m$^2$. When the coating amount is smaller than the above range, the density of the obtained dyed image is too low. The coating amount of larger than the above range is apt to cause a lowering in the transfer sensitivity and such an unwanted transfer of the dyeable heat-meltable layer as mentioned above.

According to the present invention, a release layer composed of a wax as a main component may be interposed between the support, and the heat-meltable ink layers for respective colors or the dyeable heat-meltable layer to improve the release of these layers from the support. Further, an adhesive layer composed of a wax as a main component may be provided on the heat-meltable ink layers for respective colors for a main purpose of improving mutual adhesion of different color ink dots.

Usable as the support for the transfer medium are polyester films such as polyethylene terephthalate film, polyethylene naphthalate film and polyarylate film, polycarbonate films, polyamide films, aramid films and other various plastic films commonly used for the support of ink ribbons of this type. Thin paper sheets of high density such as of condenser papar can be used. The thickness of the support is preferably within the range of about 1 to 10 μm, more preferably about 2 to 7 μm, for better heat conduction.

On the back side (the side adapted to come into slide contact with a thermal head) of the support may be formed a conventionally known stick-preventive layer. Examples of the material for the stick-preventive layer include various heat-resistant resin such as silicone resin, fluorine-containing resin and nitrocellulose resin, and other resins modified with these heat-resistant resins such as silicone-modified urethane resins and silicone-modified acrylic resins, and mixtures of the foregoing heat-resistant resins and lubricating agents.

As the foundation for master sheet on which a master image is formed, there can be used materials similar to those referred to as the aforesaid support. Generally, however, plain papers are preferably used Plain papers having a wide range of smoothness, including a good smoothness (e.g., Bekk smoothness: about 1,000 seconds) and a very poor smoothness (e.g., Bekk smoothness: about 50 seconds), can be used.

In the transfer printing method of the present invention, a master sheet is fabricated by selectively melt-transferring ink layers Y, M and C, and optionally ink layer Bk onto a foundation for master sheet in a predetemined order according to image signals for respective colors with use of a color thermal transfer printer, thereby forming an ink image on the foundation, and selectively melt-transferring the dyeable heat-meltable layer onto the ink image.

The dyeable heat-meltable layer is transferred onto at least a part of the master sheet where the ink image is present. However, the dyeable heat-meltable layer may be transferred to cover either an area slightly larger than the ink image, or the overall surface of the master sheet.

In the present invention it is necessary to provide plural gradations for each of yellow, magenta and cyan in order to obtain intermediate colors other than yellow, magenta, cyan, green, red, blue and black. Such a color with gradations can be obtained by an area modulation method wherein one picture element is composed of M×N dot matrix where M and N are, usually, independently an integer of 2 to 8, and the number of ink dots included in the dot matrix is varied.

In the transfer printing step, the master sheet is placed on an image receptor so that the ink image on the master sheet faces the image receptor, and the resulting assembly is heated under pressure by means of a hot press machine, whereby the heat-migrating dyes contained in the ink image are permitted to migrate into the dyeable heat-meltable layer to form a dyed image therein and the heat-meltable layer having the dyed image is transferred to the image receptor, resulting in the image receptor having the dyed image.

Usable as the heating means in the transfer printing step are an electric iron, hot plate, etc. besides the aforesaid hot press machine. The heating temperature and time varies depending on the kind of the heat-migrating dye and other conditions. Generally, however, the heating temperature is suitably selected from the range of not lower than the heat-migrating temperature of the heat-migrating dye used and below the temperature at which the heat shrinking of the image receptor and master sheet used takes place, and the heating time is suitably selected from the range of about 5 seconds to 2 minutes. When the heating temperature is from about 180° C. to 220° C., a dear dyed image can be obtained in a short heating time of about 5 to 30 seconds.

As the image receptor or substrate, there can be used any material without any particular limitation, including woven fabrics, non-woven fabrics, paper sheets, films, sheets and moldings of plastics, metal plates, and wood plates. Usable as the fiber for fabrics, and the like, are not only polyester fibers but also nylon fibers, acrylic fibers and cotton fibers.

The present invention exerts the following advantage in the transfer printing step. That is, in the transfer printing step, only the heat-migrating dye is transferred to the dyeable heat-meltable layer from the master image and only the dyed heat-meltable layer is transferred to an image receptor such as a fabric cloth with the ink vehicle contained in the master image remaining in the master sheet because the ink vehicle contained in the master image is readily absorbed into the master sheet foundation such as plain paper sheet upon hot-pressing and the master image on the master sheet can be readily separated from the dyed heat-meltable layer on the image receptor after hot-pressing. Accordingly, the image receptor with the dyed heat-meltable layer is not contaminated by the ink vehicle and can be used as it is, without cleaning or laundry.

When each of the ink layers for respective colors has the aforesaid melting or softening point and melt viscosity and the dyeable heat-meltable resin has the aforesaid melting or softening point and melt viscosity and, more preferably the melt viscosity of each ink layer (when the release layer and/or the adhesive layer are provided, the melt viscosity of the whole of each ink layer, and the release layer and/or the adhesive layer) is smaller than that of the dyeable heat-meltable resin at the heating temperature (for example, 200° C.) in the transfer printing step, the dyed image on the image receptor is more favorably prevented from staining due to the ink vehicle.

The present invention will be more fully described by way of Examples. It is to be understood that the present invention is not limited to the Examples, and various changes and modifications may be made in the invention without departing from the spirit and scope thereof.

EXAMPLE 1

A release layer composed of a wax and having a coating amount of 1.0 g/m$^2$ was provided on a continuous polyester film having a thickness of 6 μm and a width of 246 mm. The coating liquids for ink layers for yellow, magenta and cyan of respective formulas shown in Table 1 and the coating liquid for the dyeable heat-meltable layer mentioned below were applied onto the release layer and dried to provide an arrangement of the ink layers and the dyeable heat-meltable layer as shown in FIG. 1. An adhesive layer composed of a wax and having a coating amount of 1.0 g/m$^2$ was formed on those layers to give a heat-melt transfer medium. Each of the ink layers and the dyeable heat-meltable layer had a length of 270 mm along the longitudinal direction of the support. The coating amount of each ink layer was 1.0 g/m$^2$ and that of the dyeable heat-meltalbe layer was 2.5 g/m$^2$.

| Coating liquid for dyeable heat-meltable layer | |
|---|---|
| Component | Parts |
| Polyester resin (softening point: 120° C., melt viscosity 150 cP/200° C.) | 28 |
| Coloidal silica | 2 |
| Methyl ethyl ketone | 70 |

TABLE 1

| | Yellow | Magenta | Cyan |
|---|---|---|---|
| Formula of ink (part) | | | |
| Yellow-A-G*[1] | 6.0 | — | — |
| Red-130*[2] | — | 8.3 | — |
| Blue-F-R*[3] | — | — | 9.8 |
| Carnauba wax | 6.4 | 5.0 | 4.3 |
| Paraffin wax | 5.6 | 4.7 | 3.6 |
| EVA*[4] | 6.0 | 6.0 | 6.2 |
| Toluene | 76.0 | 76.0 | 76.1 |
| Ink layer | | | |
| Content of dye (%) | 25 | 35 | 41 |
| Melting point (°C). | 73 | 73 | 73 |

*[1]Disperse Yellow 54 made by Nippon Kayaku Co., Ltd.
*[2]Disperse dye made by Nippon Kayaku Co., Ltd.
*[3]Solvent Blue 105 made by Nippon Kayaku Co., Ltd.
*[4]Ethylene-vinyl acetate copolymer (softening point: 135° C.)

EXAMPLE 2

The same procedures as in Example 1 except that the coating amount of the dyeable heat-meltable layer was changed to 8 g/m$^2$ were repeated to give a heat-melt transfer medium.

Comparative Example

The same procedures as in Example 1 except that the dyeable heat-meltable layer was not provided were repeated to give a heat-melt transfer medium.

With use of each of the thus obtained heat-melt transfer media, a master sheet was fabricated by selectively transferring the yellow, magenta and cyan ink layers in this order onto a foundation for master sheet specified below by means of a thermal transfer printer specified below to form ink images comprising combinations of ink dots for respective colors specified below, and finally transferring the dyeable heat-meltable layer onto the ink images. In Comparative Example, the ink images were not covered by the dyeable heat-melt layer. The master sheet was then placed on a cotton fabric, and the resulting assembly was hot-pressed under the conditions noted below by means of a hot press machine to form dyed images thereon.

Printer: B-30 made by Tokyo Electric Co. Ltd. Master sheet foundation: plain paper sheet having a thickness of 70 μm and a Bekk smoothness of 360 seconds Combinations of ink dots:

(1) Only yellow ink dots (primary ink image)

(2) Only magenta ink dots (primary ink image)

(3) Only cyan ink dots (primary ink image)

(4) superimposing of yellow ink dots, magenta ink dots and cyan ink dots (tertiary ink image)

Hot press:

Heating temperature: 200° C.

Heating time: 15 seconds

Pressure: 2 kg/cm$^2$

The obtained dyed images were measured for optical reflection density (OD value) with a densitometer, Macbeth RD-914. The results are shown in Table 2.

TABLE 2

| Color of dyed image | Density of dyed image (OD value) | | |
|---|---|---|---|
| | Ex. 1 | Ex. 2 | Com. Ex. |
| Yellow | 1.2 | 1.3 | 0.8 |
| Magenta | 1.2 | 1.3 | 0.7 |
| Cyan | 1.2 | 1.3 | 0.7 |
| Black | 1.2 | 1.3 | 0.8 |

In addition to the materials and ingredients used in the Examples, other materials and ingredients as set forth in the specification to obtain substantially the same results.

What is claimed is:

1. A transfer printing method comprising the steps of: selectively melt-transferring at least one of a heat-meltable ink layer Y containing a heat-migrating dye for yellow, a heat-meltable ink layer M containing a heat-migrating dye for magenta and a heat-meltable ink layer C containing a heat-migrating dye for cyan onto a foundation for master sheet in a predetermined order according to image signals to form a primary ink image, a secondary ink image or a tertiary ink image on the foundation, selectively melt-transferring a heat-meltable layer T containing as a major component a heat-meltable resin which is readily dyeable with each of the heat-migrating dyes, onto the ink image, giving a master sheet, and placing the master sheet on an image receptor so that the ink image faces the image receptor, and heating the resulting assembly under pressure to form a dyed image within said layer T on the image receptor.

2. The transfer printing method of claim 1, wherein the readily dyeable heat-meltable resin is a polyester resin.

3. The transfer printing method of claim 1, wherein each of the ink layers Y, M and C has a melting or softening point of about 50° to 90° C. and a melt viscosity of 300 to 5×10$^5$ cP at 90° C., and the readily dyeable heat-meltable resin has a melting or softening point of about 80° to 160° C. and a melt viscosity of about 100 to 4,000 cP at 200° C.

* * * * *

UNITED STATES PATENT AND TRADEMARK OFFICE

CERTIFICATE OF CORRECTION

PATENT NO. : 5,561,098

DATED : October 1, 1996

INVENTOR(S) : Manabu Ikemoto

It is certified that error appears in the above-identified patent and that said Letters Patent is hereby corrected as shown below:

Column 1, line 34 delete "is".

Column 5, line 54 after "unwanted transfer of the ink layer" insert -- occurs --.

Column 5, line 55 after "which means" insert -- that --.

Column 6, line 38 delete "addition" and substitute therefor -- additional --.

Column 7, line 21 delete "papar" and substitute therefor -- paper --.

Column 7, line 37 after "used" insert a period -- . --.

Column 8, line 16 delete "dear" and substitute therefor -- clear --.

Signed and Sealed this

Twenty-fourth Day of October, 2000

*Attest:*

*Attesting Officer*

Q. TODD DICKINSON

*Director of Patents and Trademarks*